US008388197B1

(12) United States Patent
Huang et al.

(10) Patent No.: US 8,388,197 B1
(45) Date of Patent: Mar. 5, 2013

(54) LED LAMP

(75) Inventors: Tsung-Chin Huang, New Taipei (TW); Chang Hang Tsai, New Taipei (TW)

(73) Assignee: Cooler Master Co., Ltd., New Taipei (TW)

( * ) Notice: Subject to any disclaimer, the term of this patent is extended or adjusted under 35 U.S.C. 154(b) by 0 days.

(21) Appl. No.: 13/288,400

(22) Filed: Nov. 3, 2011

(51) Int. Cl.
*F21V 29/00* (2006.01)

(52) U.S. Cl. ..... 362/373; 362/218; 362/294

(58) Field of Classification Search ..... 362/186, 362/216, 217.01, 217.02, 217.07, 218, 240, 362/249.11, 264, 268, 294, 362, 373, 375
See application file for complete search history.

(56) References Cited

U.S. PATENT DOCUMENTS 4,746,840 A * 5/1988 Lim ..... 315/58
5,720,548 A * 2/1998 Geary ..... 362/260
5,791,769 A * 8/1998 Yang ..... 362/294

* cited by examiner

*Primary Examiner* — Vip Patel
(74) *Attorney, Agent, or Firm* — Li & Cai Intellectual Property (USA) Office

(57) ABSTRACT

The instant disclosure relates to a lamp having a heat dissipating lamp shell particularly suitable for housing solid state light sources. The lamp comprises a lamp shell of stamping construction and a light source unit. The lamp shell comprises an outer pot portion and an inner tray portion substantially concentrically coupled to the outer pot portion. Externally, the lamp shell forms a substantial portion of the lamp. The light source unit comprises a light module disposed on the inner tray portion of the lamp shell, a controller placed at the rear portion of the lamp shell, and an electrical connecter arranged exposedly from the rear of the lamp. The lamp shell of stamping construction is beneficially characterized by the light weight and strong structural integrity, which attribute to the work hardening property of the stamping process.

20 Claims, 8 Drawing Sheets

LED LAMP

BACKGROUND OF THE INVENTION

1. Field of the Invention

The instant disclosure relates generally to a lamp having a heat dissipating lamp shell of stamping structure, and pertains particularly to a lamp that utilizes a strong light weight lamp shell of stamping structure that functions as both a heat sink and a protective housing.

2. Description of Related Art

Solid state light sources generally offer superior service life and energy efficiency over traditional light sources. Modern solid stage light sources, such as light emitting diodes (LEDs), are capable of generating lumen output comparable to (or even surpassing) that of the traditional light sources at only a fraction of the energy consumption. Compared to traditional lighting sources, such as incandescent or halogen lights, LED creates visible light with considerably reduced heat generation or parasitic energy dissipation. Moreover, the LED light sources are not only physically compact in size but also generally more resistant to shock and vibration. Furthermore, LEDs of different compositions are capable of offering a wide spectrum of output colors, thus conveniently eliminating the need for traditional color filters.

While LEDs offer higher energy efficiency at lower operating voltage requirements, these solid state lighting devices are inherently vulnerable to heat damage. Unfortunately, current high power LED light sources still generate significant level of heat output. Thus, the illuminating performance of these solid state lighting devices may be severely impaired by the high temperature that results from excessive waste heat.

U.S. Pat. No. 7,871,184 B2, owned by the instant Applicants, provided an effective heat dissipating structure for a LED lamp. The rather complicated shape of the heat dissipating structure disclosed therein helps to maximize surface area of the heat sink, thus effectively improves the heat removal capacity. However, the complicated shape of the heat dissipating structure requires the employment casting construction. Generally, casting process requires high initial cost for the molding equipments and significant level of energy consumption to preserve the molten materials in the working condition. Moreover, products made by casting process are inevitably heavier due to the higher casting weight requirement of the fluid materials. Furthermore, the potential porosity remained in the casted structure is inherently hazardous to the structural integrity thereof.

In comparison, stamping process (particularly cold stamping process), whose work piece is based around sheet materials, is more material conserving and energy efficient. Moreover, stamping process may yield products that are thin and light weight. Furthermore, structural integrity of the materials undergone drawing or stamping process may be enhanced through work hardening.

Therefore, it is desirable to provide a light weight yet effective heat dissipating structure capable of serving as both a heat sink and a protective housing for a lighting device.

SUMMARY OF THE INVENTION

One particular aspect of the instant disclosure is to provide a lamp that having a heat-dissipating structure of light weight and high efficiency, which can used as a heat-dissipating device and a housing of illuminator.

Embodiments of the instant disclosure provide a lamp particularly suitable for housing solid state light sources. The lamp comprises a heat dissipating lamp shell and a light source unit. The heat dissipating lamp shell has a first port and a second port opposite to the first port, the lamp shell includes an outer pot portion, an inner tray portion which is arranged in the outer pot portion and has a bottom portion coupled to a bottom portion of the outer pot portion. The light source unit comprising a light module disposed on the inner tray portion of the lamp shell and arranged toward the first port thereof.

The lamp shell in accordance with the instant disclosure is beneficially characterized by light weight and strong structural integrity, which attribute to the work hardening property of the stamping process.

The above characteristics of the instant disclosure will become more readily apparent to those of ordinary skill in the art after reviewing the following detailed description and the accompanying drawings.

DETAILED DESCRIPTION OF THE PREFERRED EMBODIMENTS

The instant disclosure will be described more specifically with reference to the following embodiments. It is to be noted that the following descriptions of preferred embodiments are provided herein for purpose of illustration and description. It is not intended to be exhaustive or limiting to the precise form disclosed.

Figure 1:
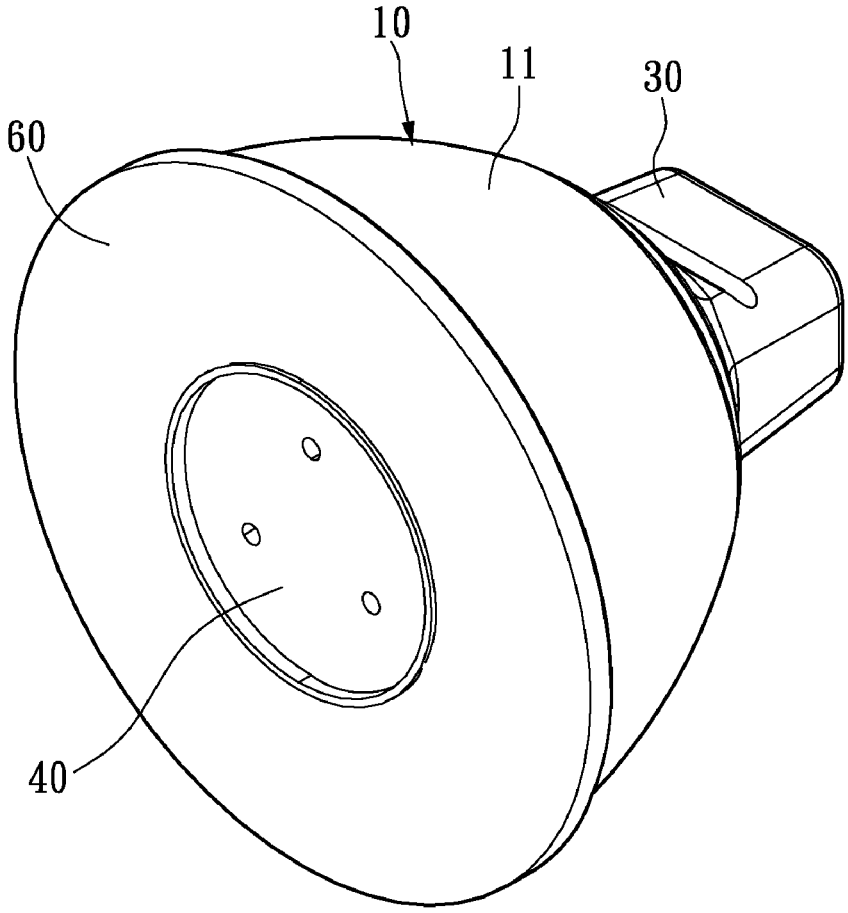
FIG. 1 illustrates an external perspective view of a lamp having a lamp shell of recessive style in accordance with the instant disclosure.
Figure 7:
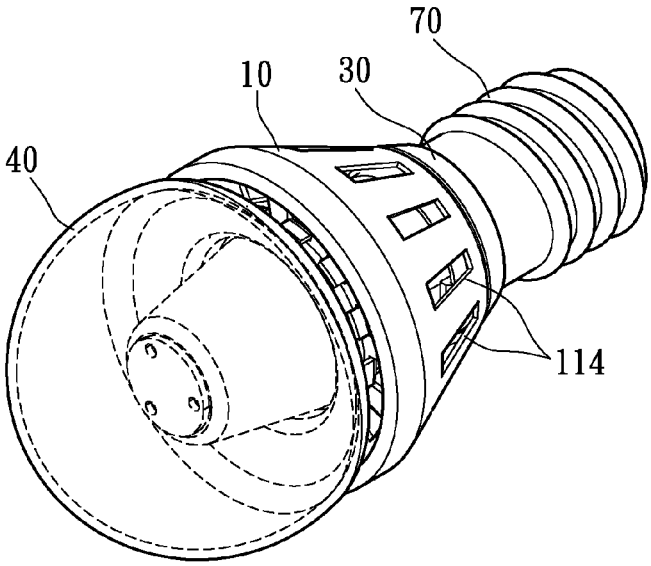
FIG. 7 an external perspective view of a lamp having a lamp shell of protruding style in accordance with the instant disclosure.

Please refer to FIGS. 1 & 7, which illustrate embodiments of LED lamps in accordance with the instant disclosure. Particularly, some external features of the exemplary lamps as shown herein resemble that of the conventional lighting devices for the purpose of maximizing compatibility and adaptability onto existing lamp housings.

Figure 2:
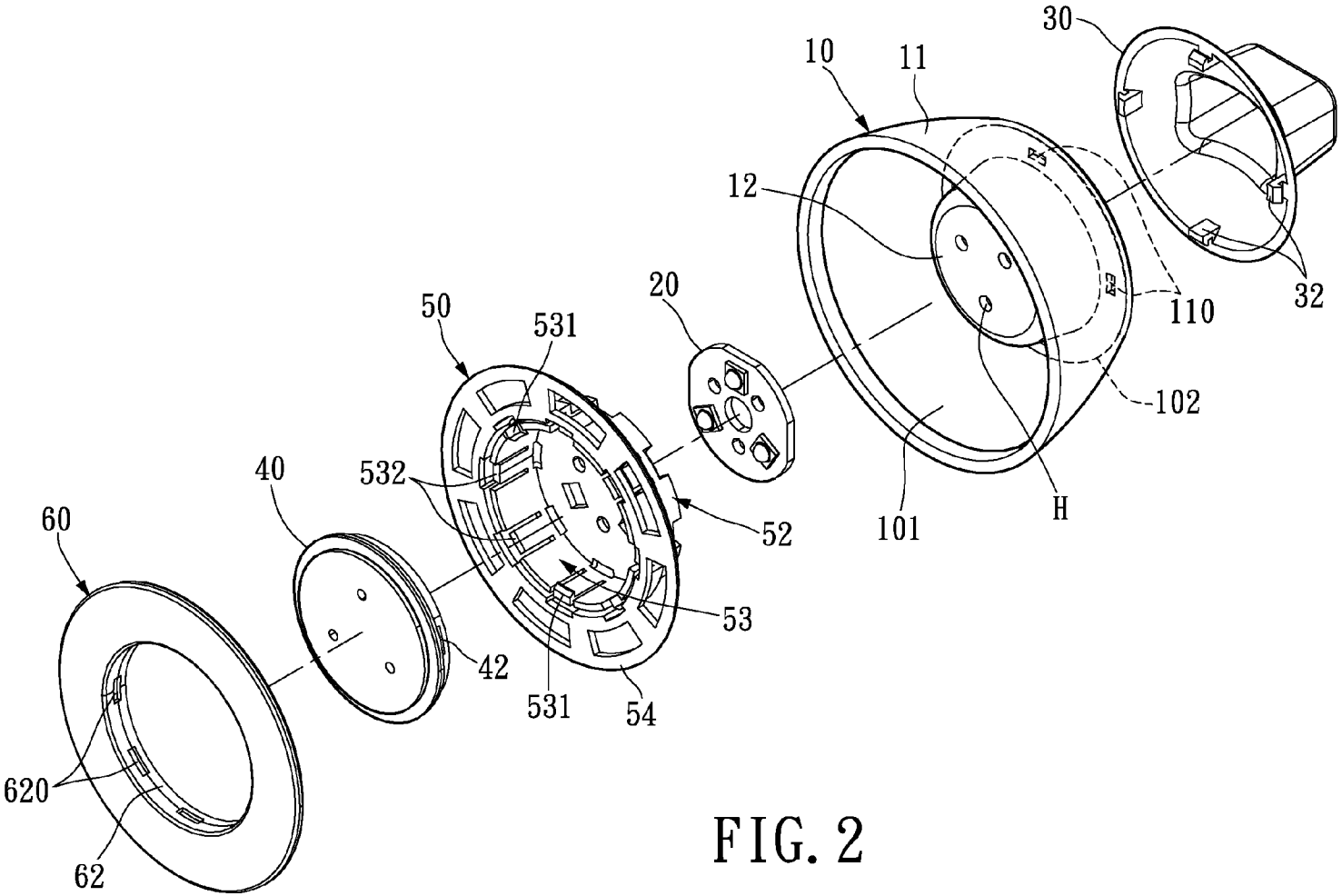
FIG. 2 shows an exploded view of an exemplary lamp having a lamp shell of integral recessive configuration in accordance with the instant disclosure.

Reference is now made to FIGS. 1 and 2. Generally, the lamp includes a heat dissipating lamp shell 10, a light module 20, a connector housing 30, an optical unit 40, a holder 50 and a front cover 60. Externally, the exemplary lamp has a heat dissipating shell 10 that substantially resembles the external shape of a bowl, on which a light projecting front port 101

(also interchangeably referred to as a first port) and a connecter receiving rear port 102 (also interchangeably referred to as a second port) are respectively defined. The light module 20 (as shown in FIG. 2) is housed in the heat dissipating shell 10 with its light emitting surface arranged toward the front port 101 of the lamp. The rear cover 30 (also interchangeably referred to as the connector housing 30) is arranged at the rear portion of the heat dissipating shell 10 for housing necessary electrical components of the lamp, such as a LED driver IC (not shown), as well as the corresponding electrical connectors. To maximize adaptability and compatibility, the rear cover 30 may be shaped to resemble that of a conventional halogen lamp for housing a GU5.3 bi-pin connector therein with the connecting pins protruding there-from toward the rear of the lamp, as shown in FIG. 1. Likewise, the rear cover 30 may be configured to resemble that of a traditional incandescent bulb with an E27 screw connector 70 attached thereon, as shown in FIG. 7.

Please refer to FIG. 2, which shows an exploded diagram of one exemplary embodiment of the lamp shown in FIG. 1. The lamp shell 10 in accordance with the instant disclosure is preferably made from a stamped sheet material having good thermal conducting characteristics, such as aluminum. The choice of material for the lamp shell 10 is not limited to metal; any material having sufficient thermal conductivity and plasticity suitable for deep stamping process may be utilized to form the lamp shell 10. The thickness of the lamp shell substrate may vary depending on the specific material selected. Take FIG. 2 as an illustrative example. Structurally, a lamp shell 10 in accordance with the instant disclosure comprises an outer pot portion 11 (also referred to as the outer shell, as these two terms are meant to be used interchangeably) and an inner tray portion 12. Viewing from the side, the outer pot portion 11 has an external form similar to that of a conical frustum, and structurally resembles a bowl having a substantially circular lateral cross section with a hollow interior defined by a continuous surrounding inner wall. However, the shape of the lamp shell 10 depends on the drawing die of choice, and is not necessarily limited to a conical frustum having a circular lateral cross section. For instance, the external shape of the lamp shell 10 may take the form of a pyramidal frustum with a plurality of planar surrounding side surfaces defining a light exiting port toward the front portion of the lamp (not shown).

Figure 3:
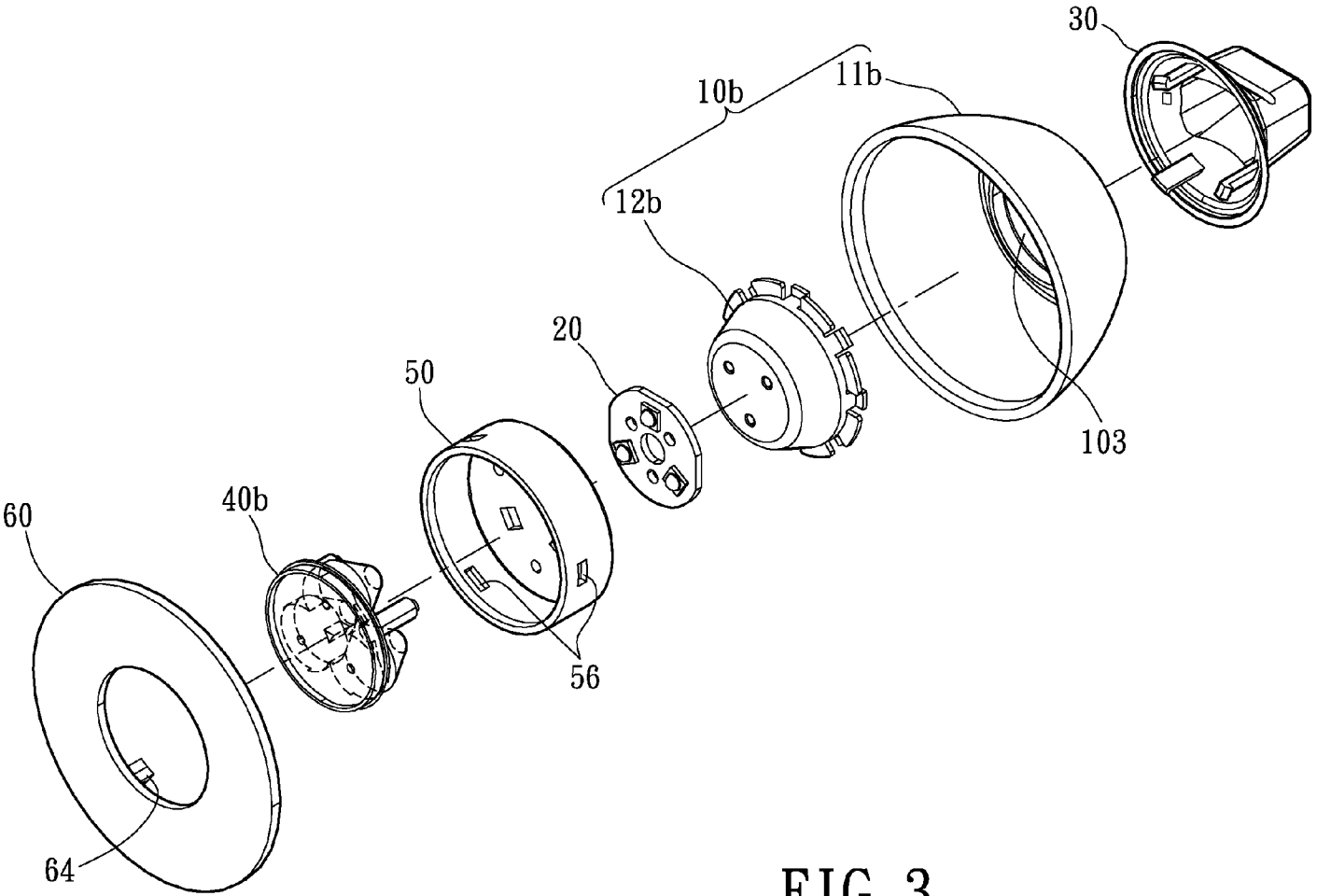
FIG. 3 shows an exploded view of an exemplary lamp having a lamp shell of composite recessive configuration in accordance with the instant disclosure.
Figure 4:
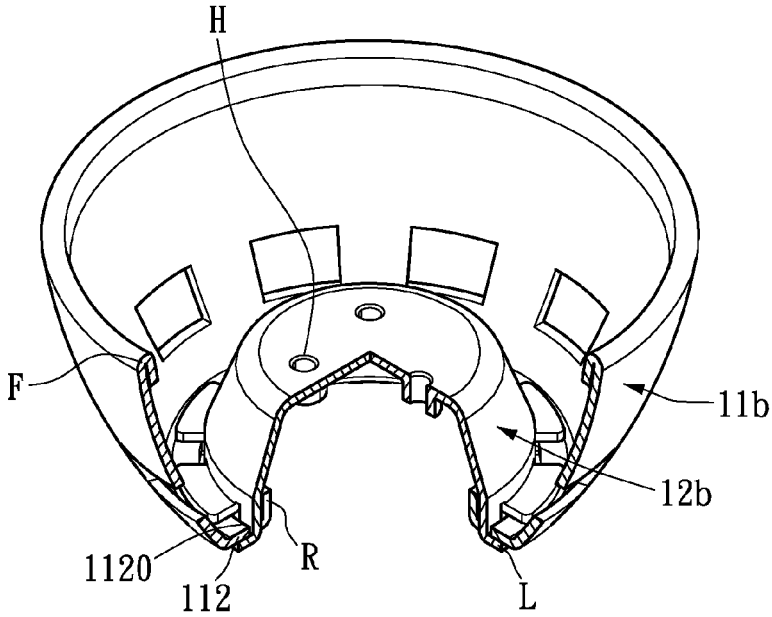
FIG. 4 illustrates the cross sectional view of an exemplary lamp shell of composite recessive configurations.

Please refer to FIGS. 3 and 4, which show a lamp shell of another embodiment having two connected pieces according the instant disclosure. An inner tray portion 12*b* is assembled to an outer pot portion 11*b*. The inner tray portion 12*b* is an inner extension member thermally and structurally connected to the outer pot portion 11*b* of the lamp shell 10*b* in a substantially concentric manner. Particularly, the inner tray portion 12*b* of the exemplary lamp shell 10*b* resembles a shallow flower drip tray with a substantially flat bottom surface for mounting the light module 20. The inner tray 12*b* may have one or more access hole (better shown as holes H in FIG. 4) arranged thereon to enable connection between the light module 20 and the corresponding electrical module housed on the other side of the inner tray 12*b* toward the rear port of the lamp shell 10.

Please refer to FIG. 2. The inner tray 12 of the lamp shell 10 serves as a thermal reservoir (or conductor) to aid the dissipation of heat from a working light module 20 to the outer shell 11 thereof, at the same time functions as a mounting seat that structurally supports the light module 20 at a preferred position with respect to the light projecting port (the rim of the front port) of the lamp shell 10.

For example, the bottom surface of the inner tray portion 12 may be recessively arranged with respect to the rim of the front port 101 in a fashion illustrated by the exemplary embodiment shown in FIG. 1. This type of arrangement is hereby referred to as the "recessive" configuration. Alternatively, the mounting surface of the inner tray 12 may be protrudingly arranged with respect to the front port, as shown by the exemplary embodiment in FIG. 7. This type of arrangement is referred to as the "protruding" configuration.

Figure 8:
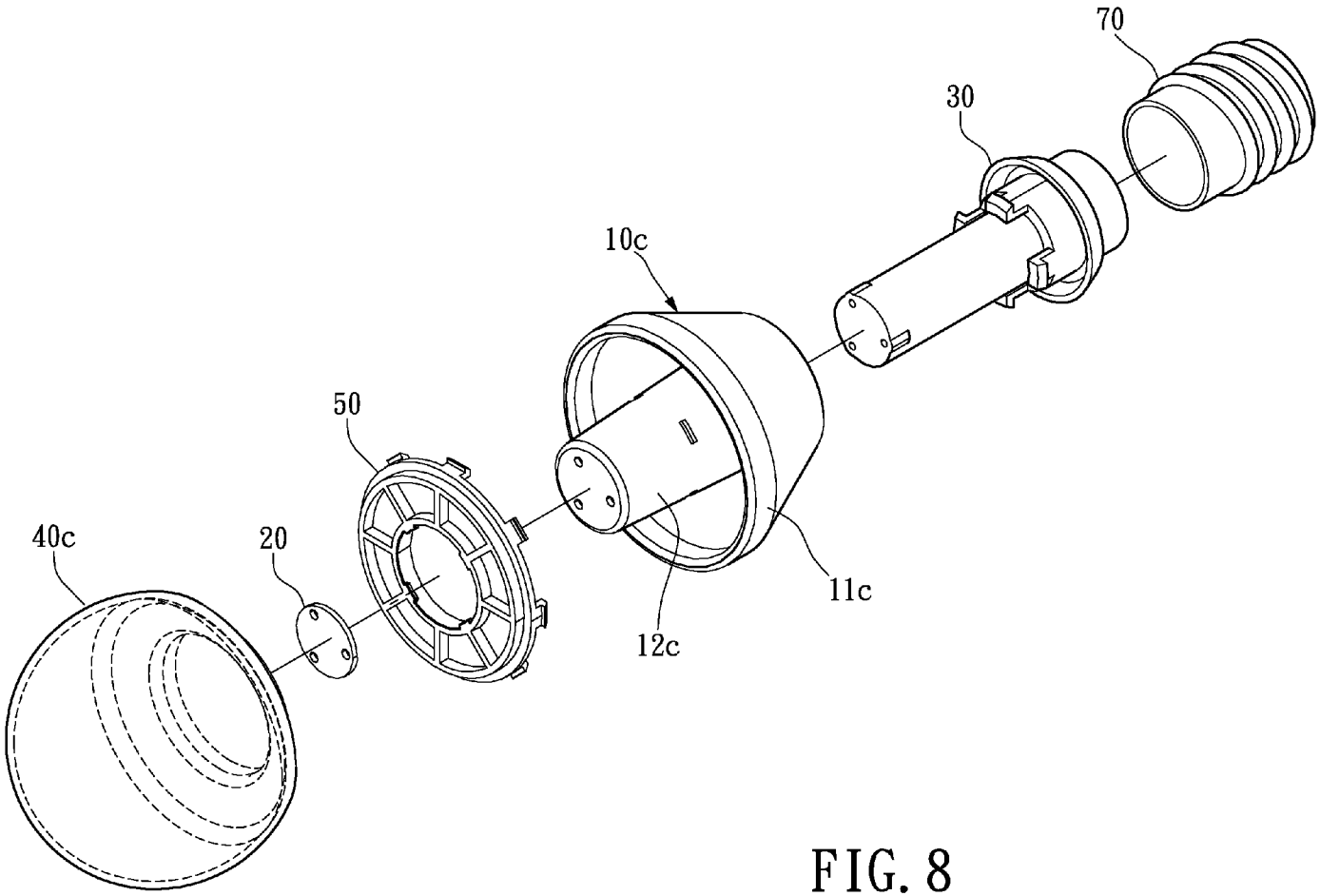
FIG. 8 shows an exploded view of an exemplary lamp having a lamp shell of integral protruding configuration in accordance with the instant disclosure.
Figure 9:
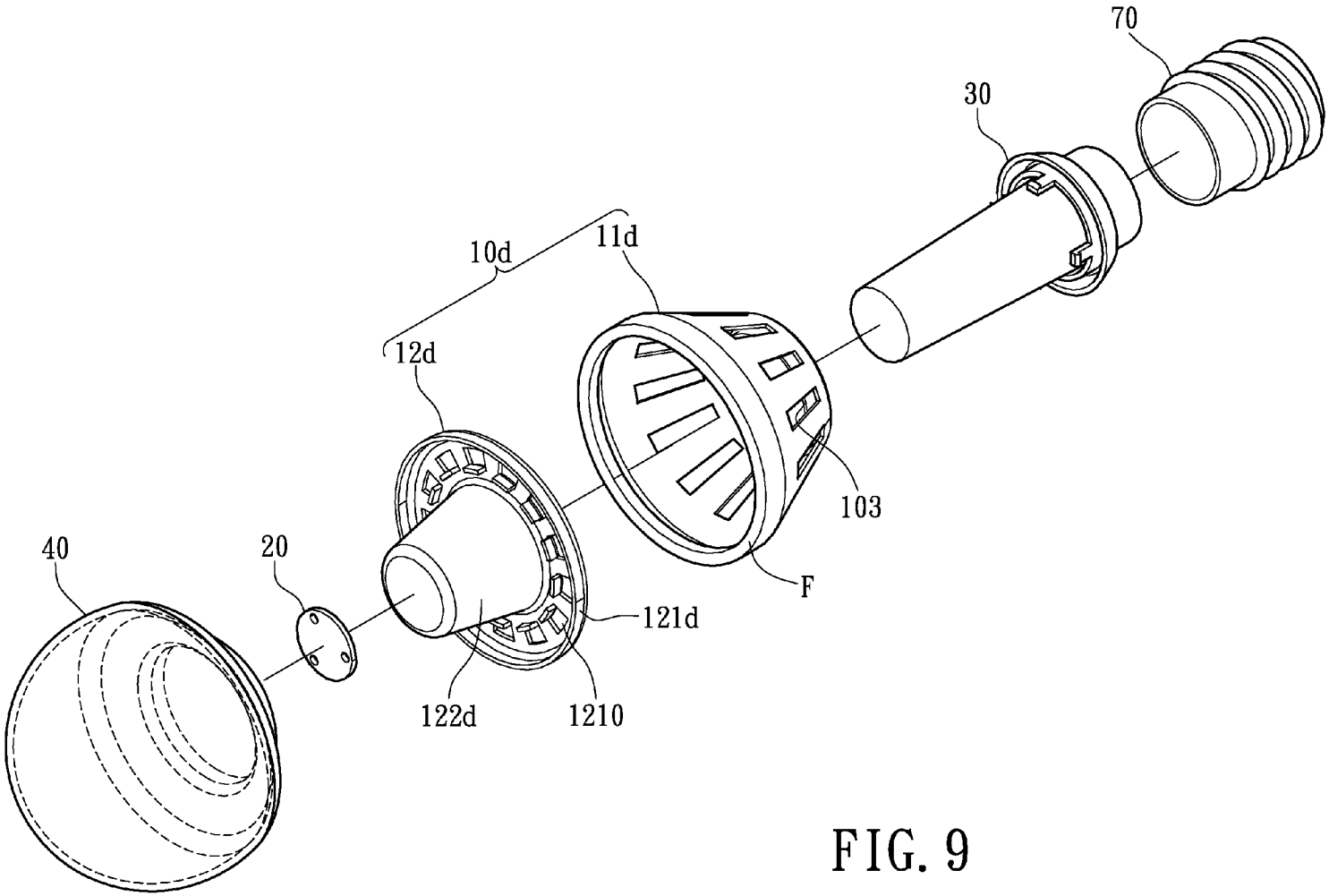
FIG. 9 shows an exploded view of an exemplary lamp having a lamp shell of composite protruding configuration in accordance with the instant disclosure.

On the other hand, the lamp shell 10 in accordance with the instant disclosure can be of one piece (integral) structure constructed from a single sheet material through a progressive die stamping process (as illustrated in FIGS. 2 and 8), or of multi-piece (composite) construction, in which two or more stamped components are used (as shown in FIGS. 3 & 9).

For example, in FIG. 2, the recessively configured lamp shell 10 is formed from a single sheet material through a progressive stamping process, with the inner tray portion 12 extendedly pressed from the rear port region of the outer shell 11. Similarly, the lamp shell 10*c* in FIG. 8 may be formed from a single sheet material through a proper deep drawing or pressing process. The protruding inner tray portion 12*c* is extendedly drawn from the rear portion center region of the sheet material. Comparing with the lamp shell 10 of the recessive configuration, the side wall of the outer shell 11*c* may have a relatively gradual outward flanging slope for compensating the greater structural strain from a deep drawing press.

In general, lamp shells of integral construction possess slightly more complicated shapes that may require more sophisticated stamping die setup, but the reduced number of components would beneficially translate to fewer assembling steps during the manufacturing process.

Alternatively, the lamp shell may be of composite construction formed by separate yet structurally interconnectable outer pot and inner tray members. Take the embodiments in FIGS. 3 & 9 for example, the lamp shell 10*b*, 10*d* is a composite unit made of separate yet interconnectable outer pot member 11*b*, 11*d* and inner tray member 12*b*, 12*d*, wherein each member is constructed respectively by stamping process. Specifically, FIG. 3 illustrated an exemplary lamp that utilizes a heat dissipating shell 10*b* of recessive composite configuration, while FIG. 9 shows an exemplary lamp that employs a lamp shell 10*d* of protruding composite configuration. In the exemplary embodiments provided above, the outer pot member 11*b*, 11*d* has a structure that resembles a flower pot with a hollow, stamped-away circular drain hole on the concave bottom portion. The remaining rim portion R on the bottom of the outer pot member 11*b*, 11*d* that defines the drain hole may be flanged inward (or toward) the front port of the lamp shell.

The inner tray member of the recessive configuration (such as element 12*b* in FIG. 3) resembles a shallow dish with a substantially flat bottom for mounting the light module 20. In contrast, the inner tray member 12*b* of the protruding configuration (such as element 12*d* in FIG. 9) has a shape resembling a filter cup with a horizontally flanged rim. In comparison, the recessive tray member 12*b* is coupled to the outer pot member 11*b* toward the rear portion (or the bottom portion) of the lamp shell, while the protruding tray member 12*d* is coupled to the outer pot member 11*d* toward the front portion instead.

Regardless of the arrangement, it is preferable to ensure a firm and robust interconnection between the inner tray member and the outer pot member to ensure the establishment of sufficient structure integrity as well as effective thermal contact. Although lamp shells of composite construction may require additional assembly steps during the manufacturing process, the reduced structural complexity of each individual component thereof require less sophisticated stamping die arrangement. This would in turn contribute to an improved yield rate in mass production.

Figure 10:
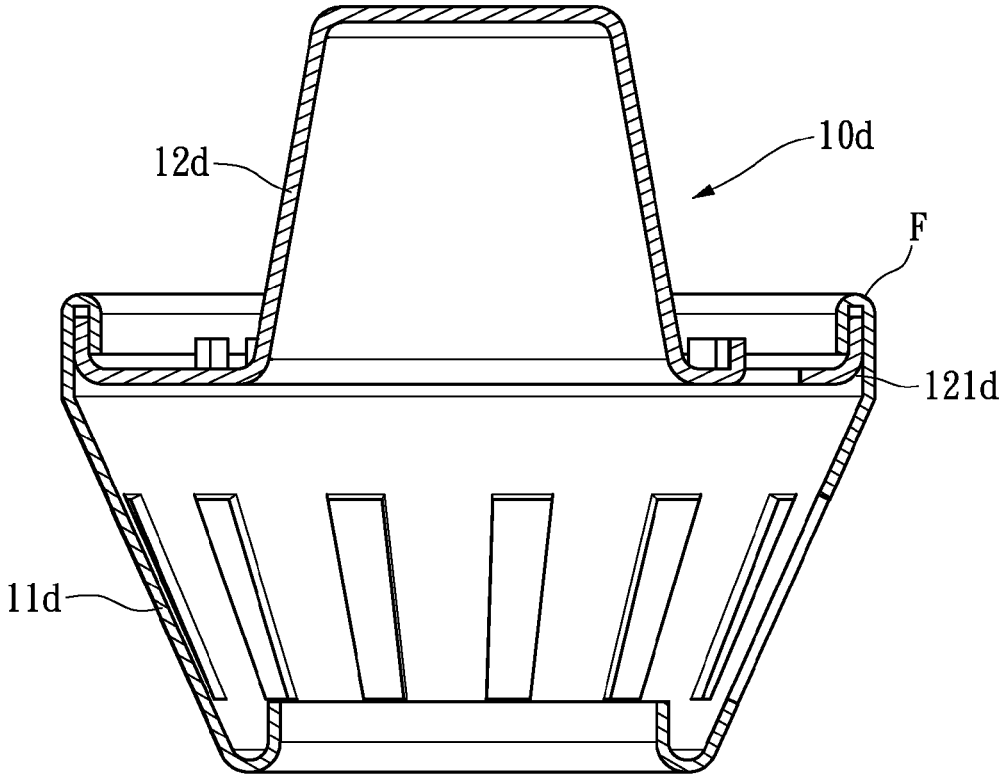
FIG. 10 illustrates a cross sectional view of an exemplary lamp shell of composite protruding configuration in accordance with the instant disclosure.

FIGS. 4 and 10 provide more detailed cross sectional views of exemplary lamp shells of composite configuration. Referring specifically to FIG. 4, a composite lamp shell of recessive configuration may comprise an outer pot member 11*b* and an inner tray portion 12*b*. In this embodiment, the bottom surface 112 of the outer shell 11*b* proximate the rear opening are arranged with a plurality of punched engaging slots around the upwardly flanged rim R. The inner tray 12*b* is formed with a plurality of corresponding latch members L designed to securely latch onto the outer pot member 11*b* through the engaging slots. The latch members L may be a plurality of radially projecting strip extensions formed along the rim portion of the inner tray member 12*b* (as shown in FIG. 2) through stamping. Each of the strip extensions is inserted into the corresponding engaging slot 1120 on the outer pot member 11*b* and then pressed to form a secure latching engagement. Optionally, the contact surfaces between the inner and the outer members may be welded to ensure secure interconnection and enhance thermal conductivity.

The rear port 102 defined on the rear portion of the outer pot member 11*b* provides room for receiving necessary electrical components. Moreover, as previously mentioned, the electrical components may be connected to the light module 20 through one or more access hole H arranged on the inner tray member 12*b*. The rim portion of the outer pot member 11*b* may be pressed to form a flanged structure F. The inwardly folded flanged structure F may improve the structural integrity around the front port region, and at the same time provide a smoother and more aesthetic appearance.

Now referring to FIG. 10 for the more detailed illustration of an exemplary composite lamp shell of protruding configuration, which shares much structural resemblance with its recessive counterpart. However, one noticeable difference rests in that the inner tray member 12*d* may be coupled to the outer pot member 11*d* at the front port region. Specifically, the rim portion of the inner tray member 12*d* has a cup portion 122*d* and a downwardly flanged edge 121*d* (toward the bottom of the cup structure). The flanged edge 121*d* is extended outwardly from an edge around the opening of the cup portion 122*d* and then bent upwardly. The flanged edge 121*d* of the inner tray 12*d* is then retained between the flanged structure F of the outer pot member 11*d* through stamping, thereby creating a firm interconnection between the inner and the outer members. Of course, welding around the contact surfaces between the inner tray 12*d* and the outer port 11*d* may be applied to further enhance the structural integrity of the lamp shell as well as improve heat conducting capability.

The compact, strong, and light weight properties of the instantly stamped heat dissipating lamp shell 10 make it suitable for application in many forms of lighting devices, particularly for low profiled solid state lighting devices such as LEDs. The light module 20 generally comprises a circuit board having one or more LED element arranged thereon. High power LEDs are preferable. Moreover, to cope with the higher heat generation of the high power LEDs, the circuit board of the light module 20 is preferably made of materials having good thermal conducting characteristics. Also, it is favorable for the circuit board to have a larger surface area, under given space constrain, for establishing optimal thermal contact with the inner tray (12, 12*b*, 12*c*, and 12*d*) of the lamp shell (10μ, 10*b*, 10*c*, 10*d*). Furthermore, the light module 20 may be mounted to the lamp shell 10 through a various methods, including fastener retention by bolts or screws, structural retention by latch or hooks, and adhesive retention such as thermal epoxy.

The rear cover 30 is configured to adapt to the rear port portion of the lamp shell 10 and provide structural accommodation for the necessary electrical components and connector, and is preferably made of strong, light weight, and electrically insulating material, such as ceramic or fiber glass. The necessary electrical components may include a LED controller in the form of a compact driver IC, which connects to the holes H, as shown in FIG. 2 or FIG. 4. The rear cover 30 may also be coupled to the lamp shell 10 through a variety of other mounting methods, including fastener retention by bolts or screws, structural retention by latch or hooks, and adhesive retention such as thermal epoxy. In the instant exemplary embodiments, the rear cover 30 is secured onto the rear portion of the lamp shell 10 by a plurality of hooking members 32. The hooking members 32 (as shown in FIG. 2) are engaged to hooking holes 110 formed on the rear portion of the lamp shell 10. The electrical component may establish connection with the light module 20 through the access hole (s) arranged on the inner tray member, and preferably by direct pin connection. The connector housing is also designed to function as the housing for the electrical connector for the lamp. As mentioned previously, the connector cover may be configured to host a GU5.3 bi-pin connector, which is commonly used in conventional halogen lamps (as shown by element 30*c* in FIG. 2). Likewise, the connector housing may be configured to conform to the standard of the E27 connector commonly used on the traditional incandescent bulbs (as shown in FIG. 8) with the additional adaptation of an Edison screw member 70 thereon (as shown in FIG. 7).

The optical unit 40 (or called as lens unit) is preferably deployed at the light exiting region of the lamp shell 10 to transmit or refract the light generated by the light module 20. The optical unit 40 may be a simple flat lens, such as the optical unit 40 shown in FIG. 2. Alternatively, the optical unit may comprise a lens module that comprises lens and reflector components, as illustrated by element 40*b* shown in FIG. 3. As a further alternative, the optical unit may be a light permitting bulb cover, as shown by element 40*c* in FIG. 8. The lens component are preferably made of light weight durable materials that are transparent to the particular spectrum of light (generally the visible spectrum) emitted by the light module 20. The transparent material of the optical unit 40 may comprise phosphor materials (such as phosphorescent materials and or fluorescent material) for enabling the generation of desired visual effects.

The optical unit 40 may be attached to the lamp through various coupling arrangements such as fastener retention by bolts or screws, structural retention by latch or hooks, and adhesive retention such as thermal epoxy. For instance, the optical unit 40 may be attached to the inner tray member or directly on the circuit board of the light module 20 (arrangement not show in the figures). Alternatively, a holder 50 may be utilized to provide structural coupling for the optical unit 40 as shown in FIG. 2, or optical unit 40*b* as shown in FIG. 3, or optical unit 40*c* as shown in FIG. 8, respectively.

In the instant embodiment of FIG. 2, the holder 50 has a disk-shaped containing portion 52, a mounting wall 53 arranged in the containing portion 52, and an annual rim 54 extended from a top edge of the containing portion 52. The mounting wall 53 of this embodiment is shaped of cylinder and forms a gap related to the containing portion 52. The mounting wall 53 has a plurality of inner hooks 531 formed inwardly, and outer hooks 532 formed outwardly. The outer hooks 532 are formed toward the containing portion 52. The optical unit 40 forms a plurality of hooking slots 42 around its periphery, which are corresponding to the inner hooks 531. The annual rim 54 is tightly fixed to the front inner edge of the outer shell 11.

In the other embodiment of FIG. 3, the holder 50 is plate shaped and formed with a plurality of hooking slots 56. The front cover 60 has an inner edge pressed against the optical unit 40*b*, so that the optical unit 40*b* is fixed in the holder 50. The bottom of the front cover 60 has a plurality of hooks 64 extended therefrom adjacent a central light exiting port thereof. The hooks 64 are engaged in the hooking slots 56 of the holder 50.

The front cover 60 is ring-shaped and has a light exiting port arranged at a central portion thereof. The light exiting port is provided for exposing the optical unit 40 may be arranged at the front portion of the lamp shell 10 to provide protection for the electrical components housed therein. As shown by the exemplary embedment in FIG. 2, the front cover 60 may be of waterproofing construction and configured to cooperatively form a tight seal with the optical unit 40 around the frontal region of the lamp, thereby enhancing the lamp's resistance to water damage. The outer edge of the optical unit 40 is tightly engaged with the inner edge of the front cover 60. The front cover 60 has a wedged wall 62 extended from an inner edge. The wedged wall 62 forms a plurality of wedged holes 620. The wedged wall 62 is disposed between the containing portion 52 of the holder 50 and the mounting wall 53. The outer hooks 532 of the mounting wall 53 are hooked to the wedged holes 620 of the wedged wall 62.

Figure 5:
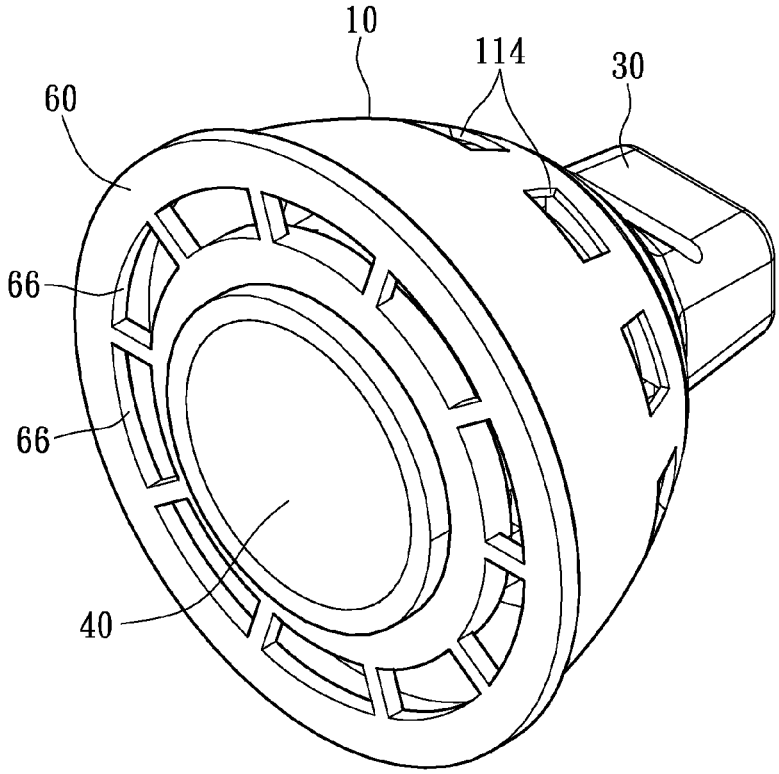
FIG. 5 illustrates an exemplary lamp having ventilating ports in accordance with the instant disclosure.

Alternatively, the front cover 60 may have a plurality of ventilating ports 66 arranged thereon (as illustrated in FIG. 5) for facilitating airflow into the lamp to enhance heat dissipating efficiency.

Please refer to FIGS. 5 and 7. To further enhance the heat dissipating effectiveness of the instant lamp, a plurality of correspondingly arranged ventilating ports 114 may be formed on the side wall of the outer pot member 11, preferably through stamping methods. For one thing, during the manufacturing of the instant lamp by stamping method, the ventilating ports 114 on the lamp shell 40 and the front cover 60 can be formed easily by punching at the desirable locations on the respective component. A plurality of correspondingly arranged ventilation ports 1210 may also be formed on the inner tray member 12*d*, as shown in FIG. 9, to help creating a plurality of air circulating channels that would in turn aid the heat dissipation through stack effect.

Figure 6:
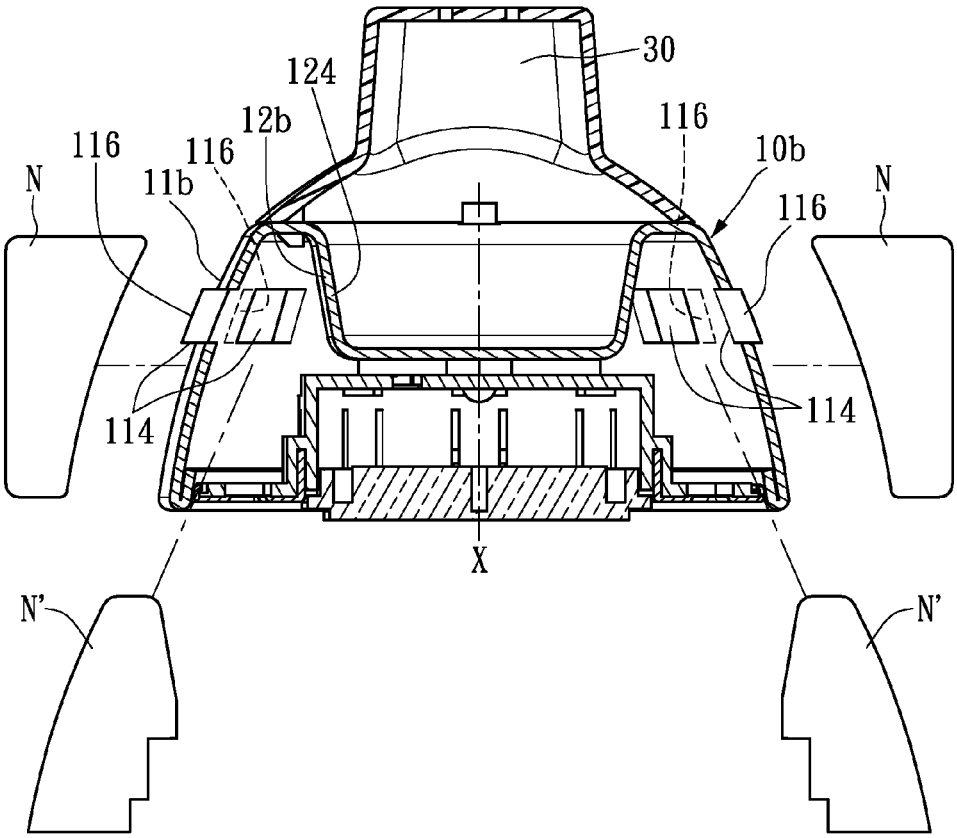
FIG. 6 shows a cross sectional view of a lamp with optional fin attachments in accordance with the instant disclosure.

Referring to FIG. 6. To enhance the heat dissipating capability even further, a plurality of heat conducting outer fins N may be adapted onto the external surface of the outer pot member 11*b*. In one embodiment, the outer fins N are arranged substantially along the central axis X of the outer pot member 11*b* and radially attached around the circumference thereof. The attachment of the fins N may be through a various methods as mentioned above, such as structural retention by latch or hooks, or adhesive retention such as thermal epoxy. However, one preferable method of fin attachment utilizes the protruding burrs resulting from the punching process as fastening means for retaining the outer fins N. Specifically, a plurality of ventilating ports are arranged on the side wall of the outer pot member 11*b* at proper intervals, so that pairs of adjacent protruding burrs form a plurality of radially distributed claw structures that can clamp onto the fins around the circumference of the lamp shell's circular side wall. The connection between the fin members and the lamp shell 10 through the claw structures from the punching process may be further strengthened by additional stamping process, welding, or even adhesives. Likewise, the same technique may be utilized to attach a plurality of inner fins N' onto the side wall 124 of the inner tray member 12*b*. Moreover, the outer edge of the inner fins N' may be configured to follow the interior contour of the outer pot member to enable the establishment of additional thermal contact between the inner and the outer shell members, as well as to further define air circulating channels that would aid in heat dissipation through stack effect.

While the invention has been disclosed with respect to a limited number of embodiments, numerous modifications and variations will be appreciated by those skilled in the art. It is intended, therefore, that the following claims cover all such modifications and variations that may fall within the true spirit and scope of the invention.

What is claimed is:

1. A lamp, comprising:

a heat dissipating lamp shell having a first port and a second port opposite to the first port, the lamp shell comprising an outer pot portion;

an inner tray portion, arranged in the outer pot portion, having a bottom portion coupled to a bottom portion of the outer pot portion; and a light source unit comprising a light module disposed on the inner tray portion of the lamp shell and arranged toward the first port thereof.

2. The lamp of claim 1, wherein the bottom portion of the inner tray portion is arranged under the first port of the lamp shell.

3. The lamp of claim 1, wherein the bottom portion of the inner tray portion is protruded outside the first port of the lamp shell.

4. The lamp of claim 1, wherein the inner tray portion is integrally extended from the second port of the lamp shell into the lamp shell.

5. The lamp of claim 1, wherein the lamp shell is of composite construction, and comprises a separate yet interconnectable outer pot and inner tray.

6. The lamp of claim 5, wherein the inner tray has a plurality of radially extending latch members, wherein the outer pot has a plurality of correspondingly arranged punched slots, wherein the latch members of the inner tray are configured to securely latch onto the outer pot through the corresponding punched slots.

7. The lamp of claim 5, wherein the outer pot portion has a flanged structure inwardly bent from a rim portion thereof;

wherein the inner tray portion comprises:

a cup portion; and a flanged edge extended outwardly from an edge around an opening of the cup portion and bent upwardly;

wherein the flanged structure of the outer pot portion clipped and fixed the flanged edge of the inner tray portion.

8. The lamp of claim 7, further comprising a connector housing detachably adapted to the second port of the lamp shell, wherein the connector housing connects to an electrical connecter.

9. The lamp of claim 1, wherein the connector housing has a plurality of hooking members, wherein a bottom part of the outer pot member of the lamp shell is formed with a plurality of hooking holes corresponding to the hooking members, the hooking members are engaged to the hooking holes correspondingly.

10. The lamp of claim 1, further comprising an optical unit arranged in front of the light module and toward the front portion of the lamp shell.

11. The lamp of claim 10, further comprising a holder that provides structural coupling between the optical unit and the lamp shell member.

12. The lamp of claim 11, wherein the holder includes:

a disk-shaped containing portion;

a mounting wall arranged in the containing portion; and an annual rim extended from a top edge of the containing portion, wherein a gap is formed between the mounting wall and the containing portion;

wherein the mounting wall includes:

a plurality of inner hooks formed inwardly; and a plurality of outer hooks formed outwardly, the outer hooks formed toward the containing portion;

wherein the optical unit forms a plurality of hooking slots around a periphery thereof corresponding to the inner hooks;

wherein the annual rim is tightly fixed to the front inner edge of the outer shell.

13. The lamp of claim 11, further comprising a front cover disposed on the first port of the lamp shell, wherein the front cover has an opening defined at a central portion thereof.

14. The lamp of claim 13, wherein the holder is plate shaped and formed with a plurality of hooking slots at a periphery thereof, wherein the front cover has an inner edge pressed against the optical unit to fix the optical unit in the holder, wherein a bottom of the front cover has a plurality of hooks extended therefrom adjacent the central opening, the hooks of the front cover are engaged in the hooking slots of the holder.

15. The lamp of claim 1, wherein the side wall of the outer pot portion includes a plurality of punched ventilation ports radially arranged at predetermined intervals.

16. The lamp of claim 15, wherein the regions around the punched ventilation ports on the side wall of the outer pot portion form a plurality pairs of protruding burr structures, wherein each pair of the protruding burr structures forms a claw member.

17. The lamp of claim 16, further comprising a plurality of outer fin members adapted on the outer surface of the outer pot portion and respectively held by the plurality of claw members, wherein the outer fin members are arranged substantially along the central axis of the outer pot portion and radially attached around the side wall thereof.

18. The lamp of claim 1, wherein the side wall of the inner tray portion includes a plurality of punched ventilation ports radially arranged at predetermined intervals.

19. The lamp of claim 18, wherein the regions around the punched ventilation ports on the side wall of the inner tray portion form a plurality pairs of protruding burr structures, wherein each pair of the protruding burr structures forms a claw member.

20. The lamp of claim 19, further comprising a plurality of inner fin members adapted on the outer surface of the inner tray portion and respectively held by the plurality of claw members, wherein the inner fin members are arranged substantially along the central axis of the inner tray portion and radially attached around the side wall thereof, wherein the inner fin members are configured to establish thermal contact between the inner tray portion and the outer pot portion.

* * * * *